United States Patent [19]

Simmons

[11] Patent Number: 4,550,837

[45] Date of Patent: Nov. 5, 1985

[54] STACKABLE SHIPPING AND DISPLAY CONTAINER

[75] Inventor: Richard J. Simmons, Carol Stream, Ill.

[73] Assignee: Plastofilm Industries, Inc., Wheaton, Ill.

[21] Appl. No.: 404,588

[22] Filed: Aug. 2, 1982

[51] Int. Cl.[4] ..... A47F 3/14

[52] U.S. Cl. ..... 211/126; 206/509; 220/236

[58] Field of Search ..... 211/128, 126, 15, 49 D, 211/194; 206/509, 503, 507; 220/23.6

[56] References Cited

U.S. PATENT DOCUMENTS

| | | | |
|---|---|---|---|
| Re. 26,758 | 1/1970 | Kreeger | 206/507 |
| Re. 27,649 | 5/1973 | Levenhagen | 206/507 |
| 1,849,659 | 3/1932 | Burks | 211/126 X |
| 2,774,511 | 12/1956 | Menkin et al. | 206/507 |
| 2,916,293 | 12/1959 | Lang | 211/126 X |
| 2,994,457 | 8/1961 | Fornas | 206/507 |
| 3,053,397 | 9/1962 | Bliss | 211/126 |
| 3,100,582 | 8/1963 | Lockwood | 206/507 |
| 3,113,680 | 10/1963 | Frater et al. | 206/507 X |
| 3,219,232 | 11/1965 | Wilson | 211/126 X |
| 3,282,458 | 11/1966 | Rudd | 206/503 X |
| 3,647,112 | 3/1972 | Limbert, Jr. | 211/126 X |
| 4,000,817 | 1/1977 | Sanders et al. | 206/507 X |
| 4,176,747 | 12/1979 | Abo | 206/509 |

FOREIGN PATENT DOCUMENTS

| | | | |
|---|---|---|---|
| 663184 | 8/1965 | Belgium | 206/507 |
| 1581001 | 12/1969 | France | 211/128 |

*Primary Examiner*—Ramon S. Britts
*Assistant Examiner*—Sarah A. Lechok Eley
*Attorney, Agent, or Firm*—Lee, Smith & Zickert

[57] ABSTRACT

A tray-like container is disclosed having an open compartment for containing articles therein when shipped. The container includes a top surface with a first downwardly depending well defining a female element, and a second downwardly depending well within the compartment bottom, laterally offset with respect to said first well defining a male element. When formed into a display structure a base having an inclined top surface is employed. Within the inclined surface is disposed a well defining a female element engageable with the male element of a container stacked thereon. The nestable engagement of the male and female elements of stackably tiered containers engaged with the inclined base form a unitary display structure wherein the articles contained within each container are accessible.

10 Claims, 5 Drawing Figures

18
10
20
40
14
38
40
14
10
28
40
20
14
38
25
28
40
14
20
28
12
10
14
20
13
10
14
28
23
15

STACKABLE SHIPPING AND DISPLAY CONTAINER

BACKGROUND OF THE INVENTION

The present invention relates generally to an article container and more particularly, to a container in which articles are both shipped and a plurality thereof stackably tiered for displaying the articles.

It is an accepted fact today that in many instances the cost of packaging and displaying articles for sale can significantly contribute to the overall cost of the merchandise. It is a continual effort, therefore, in the packaging industry to develop containers which are inexpensive yet attractive and appealing to the eye of a potential purchaser.

In the branch of merchandising directed to the sale of small articles such as gum, cough drops, or lip ice, it is a conventional practice for manufacturers to package such articles in a colorful display box. The retailer either places each such box directly on a conventional display shelf or rack, or transfers the articles themselves to a counter-top vending display. These vending display structures in many instances include inclined shelves for automatic advancement of the articles once the foremost article has been vended. After a certain number of the articles have been dispensed, the display is replenished by replacing the articles individually. Other types of display structures hold the boxed articles, thereby eliminating the need to individually handle such articles.

There are also available vending displays which are similar to those described above, but which have tiered shelving arrangements where the boxed articles, or the articles themselves, can be displayed in a vertically arrayed arrangement. Once the merchandise of one or more shelves of such a tiered arrangement becomes depleted of merchandise, and if not replenished, the framework of the display structure becomes visible and the display, as a whole, becomes unattractive because of its empty appearance. Competitive commercial considerations dictate that for maximum influence on a potential customer, the product dress, as well as the display, must be aesthetically pleasing and attention-getting.

While the merchandise displays discussed above serve an intended purpose, such displays suffer the disadvantage of being generally tailored, because of size or advertisement considerations, for specific products and, therefore, have a limited use. Such displays can be costly, must be purchased as an additional item as a prerequisite for displaying the articles, as well as necessitate being stored or discarded when the product is temporarily out of stock or discontinued. All of these aspects represent indirect expenses to the retailer which are passed on to the purchaser in the form of higher article prices.

Another major drawback of many article or merchandise displays known in the art is the time and effort required to assemble the display structure. The display structures are often complicated and require instructions and even tools or hardware such as nuts and screws to facilitate the erection thereof. Other types of displays are constructed from cardboard-like paper material with a complicated scheme of interlocking tabs and slots which must be mated—not a lot unlike putting a jig-saw puzzle together.

Accordingly, it would be highly desirable to the article manufacturer if the empty containers were compactly nestable themselves and preformed, thereby eliminating the need for a container erecting machine. It would be equally desirable to the retailer if the container in which the articles were packed was constructed in a manner such as to form an inexpensive, simple, engageable tiered display structure thereby obviating the need of a wholly separate structure.

Furthermore, as each tier were depleted of merchandise it could be simply discarded without exposing an underlying frame structure. It would be highly advantageous to the retailer to choose the size of the display, i.e., the number of containers stacked, or to occasionally change the article capacity of the display to suit one's particular needs.

SUMMARY OF THE INVENTION

In accordance with the foregoing, the present invention is directed to a container structure adapted for shipping articles and for engaging a plurality of such containers together on a base to form a tiered display.

Each shipping and display container is a tray-like structure which includes a compartment of sufficient volume to contain a predetermined quantity of articles, a male protrusion depending from the compartment bottom surface, and a complementary-shaped female well within a top surface of the container. The female element is laterally offset with respect to the male protrusion.

Each such container is molded out of an inexpensive plastic film with a slight draft angle to all sidewall surfaces such that the empty containers themselves can be nested for compact shipment to the article manufacturer. The engagement of the female element of the one container with the male element of another container tiered below it, permits multiple containers with articles held therein to be stacked one on top of the other to form a vertically offset display. With this structure, a purchaser can easily select articles from any one of the arrayed containers.

Each container further includes within the frontal sidewall a cutout so that the dispensing of the contents, such as gum or roll-candy, can be easily accomplished by grasping the same with one's fingers.

A separate base is provided which has an inclined upper surface with a shallow depression for holding the first container stacked thereon. In this manner, each subsequently stacked container in the display is also disposed at an inclined position to maintain the center of gravity of the stacked containers vertically above the base, as well as to provide automatic advancement of the articles to the front of the container by the action of gravity. With a tilted display, a purchaser is also provided with a clear view of the container contents.

The base also includes a female well for accommodating the male protrusion of the first stacked container so as to prevent movement of the base with respect to the stacked containers thereby stabilizing the structure and preventing an accidental tipping.

Further features and advantages of the invention, and the means by which they are achieved, will become apparent by referring to the description of the preferred embodiment which follows hereinafter together with the appended drawings.

DETAILED DESCRIPTION OF THE PREFERRED EMBODIMENT

Figure 1:
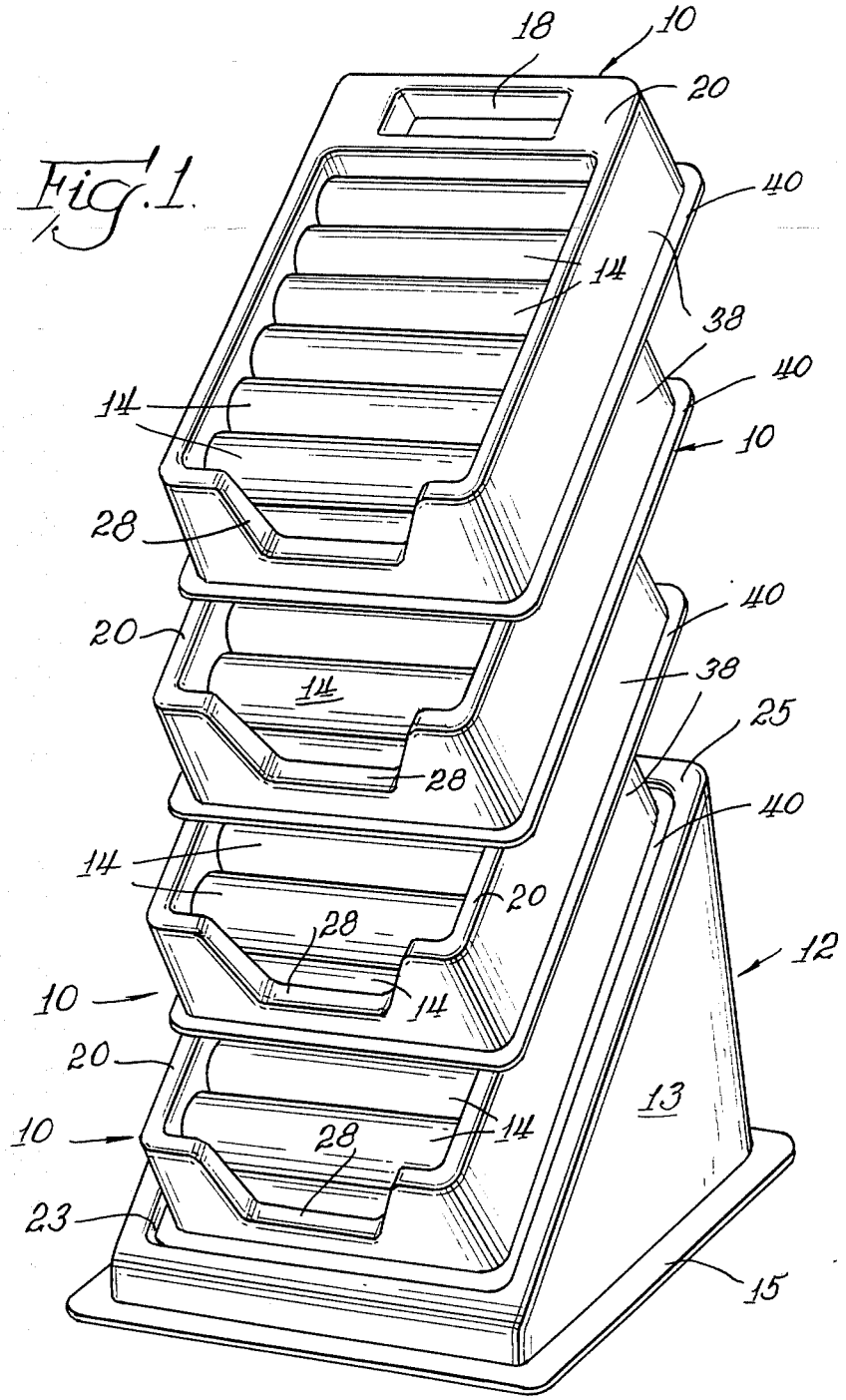
FIG. 1 of the drawings is an isometric view of an illustrated embodiment of the display structure in accordance with the invention.

Referring generally to the drawings, the shipping and display container according to the present invention is identified by the reference character 10. As seen in FIG. 1, a plurality of such open tray-like containers are shown stackably tiered one on top of the other, and supported upon a base 12. Each container 10, as well as the base 12, is uniquely constructed such that when stacked the parts thereof become engaged so as to form a unitary display structure. When shipped from the article manufacturer, the articles 14 may be banded within the container 10 by a plastic strip, or by other suitable means for holding the articles within the container. The strip, of course, is removed before engaging the containers together.

In FIG. 1, it is further seen that each tiered shipping and display container 10 is offset, in a stair-step fashion, with respect to adjacent containers thereby permitting access to the articles contained within each such container. The efficiency of this structure permits a retailer to display articles, such as different flavors of roll-candy, within each tier of the display without the need for multiple displays. As any one display tier becomes empty, it may be replaced directly with a full container as shipped, and the empty container discarded. In the alternative, and to maintain a pleasantly appearing well-stocked display, a vendor can consolidate the contents of a partially-filled container with other partially filled containers and discard the resultant empty container. It should thus be appreciated that the container of the present invention is economically desirable insofar as it serves as a shipping container as well as a display container. Moreover, the containers are preferably thermal-formed out of an inexpensive plastic, such as for example P.V.C. or Styrene, and thus can be inconsequentially discarded much like that of a paper carton.

The display base 12 includes an inclined top surface 25 for supporting the engaged tiered containers such that the center of gravity of the offset tiered structure is maintained generally above the base. This aspect prevents the display from being easily toppled over due to the combined weight of the articles within the offset structure. A flange-like lip 15 surrounds the bottom of the base 12 and provides a rigidizing member to the base as well as a support surface for resting the display upon a countertop, or the like. The display base 12 includes sufficient area on its side 13 for applying advertising indicia. However, the flexibility of the display may be enhanced if such indicia were omitted on the base itself, but rather was applied to the containers. A single base could then be reused, without changing the advertising thereon, if the nature of the articles sold was changed.

Each shipping and display container 10 includes a depending male element (not shown in FIG. 1) and a female element 18 within the top surface 20, which serves as a receptacle for engagement with the corresponding male element of a container stacked thereover. With the arrangement as shown in FIG. 1, containers can be easily added or removed from the unified display according to the need of a vendor. In other words, for articles which do not quickly sell, only relatively few containers may be necessary. On the other hand, where the articles are popular and sell quickly, the retailer may desire to stack a large number of such containers 10 together to ensure an adequate supply to potential customers. The number of tiers which may be used is limited generally by the stability of the display structure.

The preferred embodiment of the display will be discussed and illustrated hereinbelow in terms of a counter-type display for displaying small articles such as for example, roll candy. However, it should be realized that those skilled in the art may find it advantageous to utilize the principles of the present invention in other types of displays.

Figure 2:
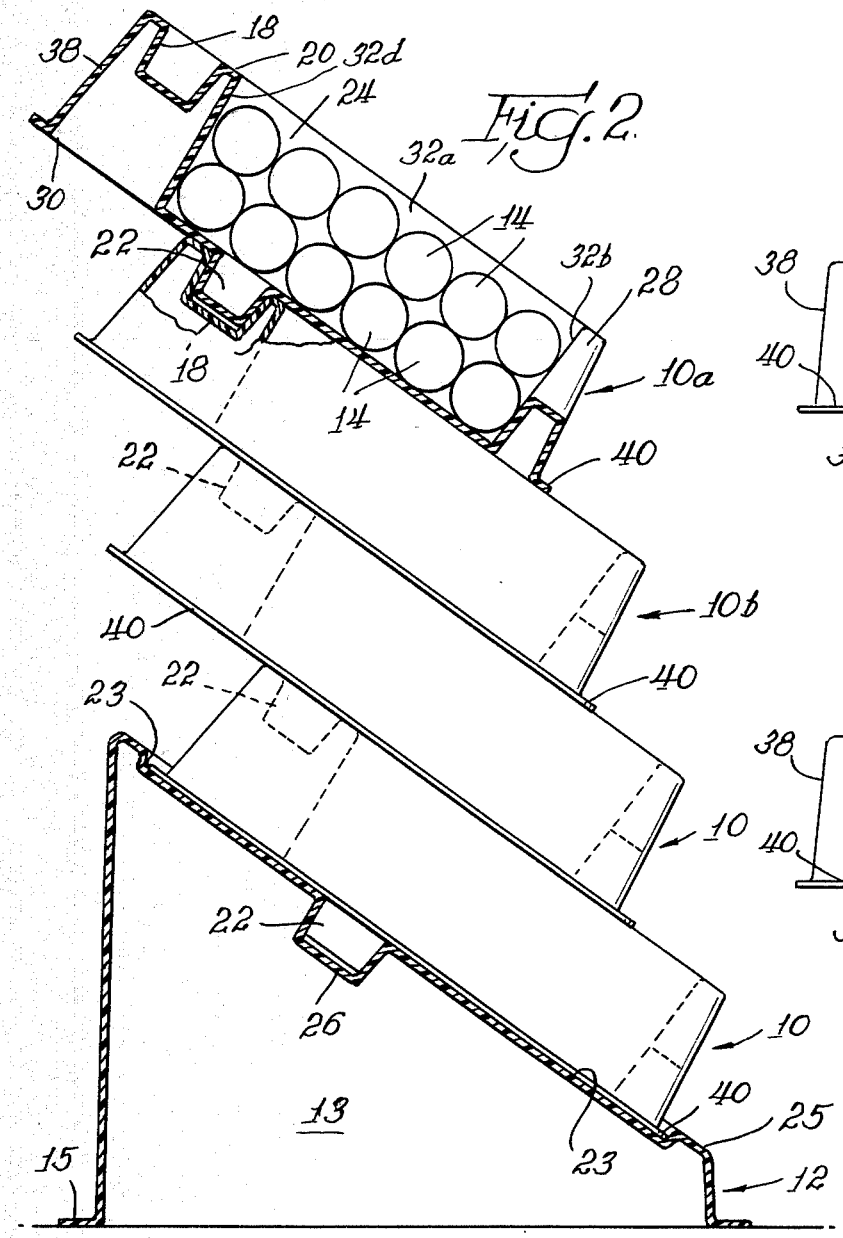
FIG. 2 is a partial cross-sectional sideview of the display illustrating the double sidewall construction, and the male and female elements cooperatively engaging one another to unite the individual containers and the base together to form a unified display structure.

With reference now to FIG. 2, there is shown a side view of the countertop display showing the cross-sections of the base 12 and two stacked engaged containers 10*a*, 10*b*. Each container includes a female element 18 in the form of a well in the top planar surface 20 of the container, and a male element 22 in the bottom surface of the article compartment 24. The male element 22 protrudes beyond the bottom surface of the container and is dimensionally undersized, as compared to the female well 18, such that it can be firmly engaged within the female element of the container stacked directly beneath it. The depth and type of fit between the male 22 and female 18 elements is of the type which requires a small amount of hand force to lift one container off another. Correspondingly, in stacking one container on top another, slight hand pressure is required to engage the two containers together by the male and female elements. This engaging arrangement, as compared to a loose-fitting engagement, adds stability and unites the containers and the base 12 into a sturdy integral upright structure.

The base 12 includes a shallow depression 23 within its top surface 25 to accommodate the bottom of the first container stacked thereon. A female element 26, in the form of a well disposed in the base upper surface depression 15, permits the first container stacked thereon to become engaged with the base 12. The base female element 26 is dimensionally identical to the female well 18 of the container 10. Because of the firm engagement of each container either directly or indirectly with the base, a unified display structure is formed which structure is easily and conveniently tiered, and compact and aesthetically pleasing to the eye. Because the base 12 is capable of supporting plural containers plus the articles 14 contained therein, it is preferable to construct the base out of a material having sufficient strength to maintain the weight of the containers and articles without deforming the base. The base 12 may even be a solid structure to form a ballast for supporting heavy articles 14, or relatively large numbers of tiers.

Figure 4:
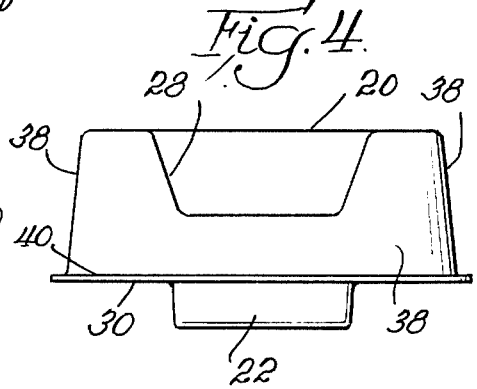
FIG. 4 is a front view of the container showing the cut-out in the front sidewall.

It is further noted from the preferred embodiment of FIG. 2 that the male 22 and female 18 elements of a container are offset with respect to each other such that when plural containers are stacked in a tiered fashion the containers themselves are correspondingly offset thereby providing easy access to the contents of each container. To further facilitate access to the articles, a cut-out 28 (FIG. 4) is provided in the front sidewall of each container thereby allowing the articles to be easily grasped by the fingers. These front sidewall cut-outs 28, as shown in FIG. 1 and FIG. 4, are somewhat smaller than the articles 14 contained therein so that they cannot roll or fall out of the container.

The offset nature of the female 18 and male 22 engagement elements additionally permit the display to be expanded vertically while yet maintaining the center of gravity generally above the inclined base 12. The angle of base incline can be chosen such that the articles contained within a container automatically advance, by the action of gravity, toward the front of the container after the foremost articles have been removed. This feature is highly advantageous as less time and hand labor is required to maintain the articles 14 readily accessible to purchasers.

Figure 3:
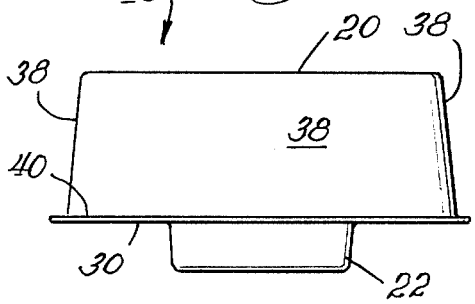
FIG. 3 is a rear view showing the male element protruding below the bottom surface of the container.

FIG. 3 is a back view of an exemplary container showing the male element 22 depending downwardly below the bottom surface 30 of the container 10. The length of the male element 22 is subsantially longer than its width (as shown in FIG. 2), it being recognized that an increase in a surface area contact between the male and female elements provides a firm engagement between stacked containers.

Figure 5:
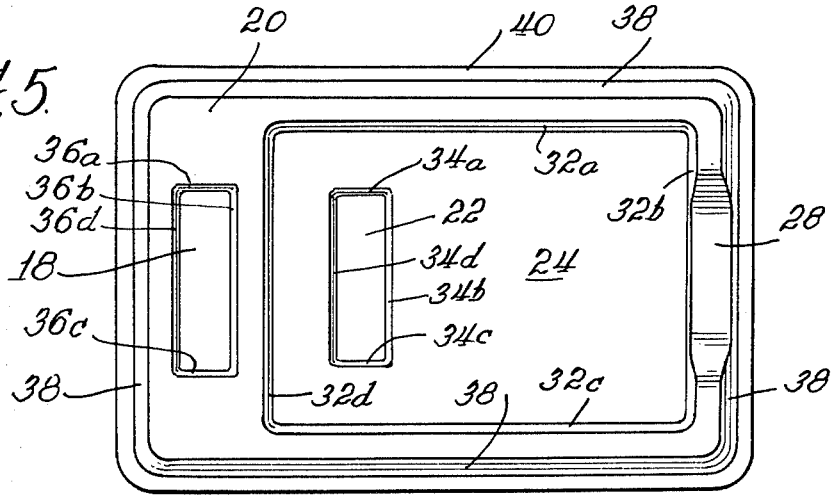
FIG. 5 is a plan view of the shipping and display container.

FIG. 5 is a top view of an exemplary shipping and display container constructed in accordance with the present invention. The container includes sidewalls 32*a, b, c,* and *d* which generally define the article compartment 24. Within the compartment bottom is formed a well defining the downward protruding male element 22. The depending male element 22 includes side walls 34*a*–34*d*. Within the top planar surface 20 of the container there is formed a well which defines the female element 18. The female well 18 is defined by sidewalls 36*a*–36*d*.

An outer circumferential sidewall 38 provides the container with a double sidewall thereby adding strength and rigidity to the container. The outer sidewall 38 terminates at the bottom surface 30 (FIG. 3) of the container and flares out to form a peripheral lip 40 which also aids in rigidizing the container. This lip 40 closely conforms to the peripheral size of the base top depression 25 thus preventing rotational motion of the tiered containers with respect to the base 12.

The female 18 and male 22 elements formed in the respective top planar surface 20, and compartment 24 bottom do not interfere when plural empty containers are nested together for bulk shipment to the article manufacturer. The compact nesting of many such containers is possible because of two aspects of the container. First, the compact nesting of empty containers can be understood from the cross-section of FIG. 2 by noting that the general contour of the container bottom surface is complementary to the contour of the top surfaces. In other words, container female wells nest together, as do corresponding male elements, and article compartments.

Secondly, the compartment sidewalls 32*a*–32*d*, the male element sidewalls 34*a*–34*d*, and the female element sidewalls 36*a*–36*d*, as well as the circumferential outer sidewall 38 all include a slight draft angle, thereby aiding the nesting and the separation of plural containers. The sidewalls of the article compartment 24, the male element 22 and the female element 18 all taper inwardly toward their respective bottom surfaces. In contrast, the outer circumferential sidewall 38 is angled outwardly from the container top to its bottom. The slight draft angle of the inner and outer container sidewalls facilitates the hot molding of the container and the removal of the container from its mold.

With regard to the foregoing, it should be seen that an attractive, inexpensive and space saving article display has been provided. The display includes a base upon which a plurality of shipping and display containers are stackably tiered. The ease with which the display is set up is apparent as the container within which the articles are shipped are stackable in a tiered fashion on the base for displaying the articles without having to transfer the articles from a shipping container to a display structure.

Although the present invention has been described in terms of the preferred embodiment, it should be understood that this disclosure has been made only by way of example. Consequently, numerous changes in the details of construction, as well as the possible modes of utilization, will be apparent to those familiar with the art and may be resorted to without departing from the scope of the invention as claimed hereinbelow.

What I claim is:

1. A container for nesting together with other similar containers when empty and adapted to be stackably tiered when used for dispensing articles contained therein, comprising:

a container having a plurality of sidewalls defining a compartment for containing said articles, each said sidewall having a draft angle for nesting with empty compartments of said similar containers, and an opening through which said articles can be dispensed;

first engaging stacking means integral with said container, being hollow and having peripherally enclosed sidewalls with a draft angle for nesting with hollow first engaging stacking means of said similar containers;

second engaging stacking means integral with said container, being hollow and having peripherally enclosed sidewalls with a draft angle for nesting with hollow second engaging stacking means of said similar containers, said first and second engaging stacking means are located so as to be removed from and independent of the sidewalls of said compartment, and wherein said second engaging stacking means of said container is engageable with a first engaging stacking means of said similar containers when said container is stackably tiered with said similar container.

2. The container of claim 1 wherein said first and second engaging stacking means are offset with respect to each other such that when said container is stackably tiered with said similar containers each container is correspondingly offset with respect to the others.

3. The container tray of claim 1 or 2 further including in combination a base having an inclined top surface for supporting thereon a plurality of stackably tiered containers, and means disposed on said surface for engaging one of said first and second engaging stacking means such that the first container supported thereon is firmly engaged with said base.

4. A unitary shipping container for nesting together with other similar empty containers when empty, and adapted to be stackably tiered in a staggered arrangement when used for displaying articles contained therein, comprising:

an open tray-like container in which said articles are shipped, said container having a bottom and continuous planar sidewalls defining a compartment for containing articles, each said sidewall having a draft angle for nesting with empty compartments of said similar containers;

a hollow male element having peripherally enclosed and drafted angle sidewalls and depending downwardly from the bottom of said compartment so that when a plurality of said containers are nested the hollow male elements thereof are also nested, a female element independent of and removed from said compartment, and wherein said male element and female element of said container are engageable with a respective complementary female and male element of other similar containers stackably tiered respectively below and above said container, whereby a tiered engaged and vertically staggered arrangement of said containers forms a unified display.

5. The container of claim 4 wherein said male and said female elements are laterally offset with respect to each other such that when a plurality of said containers are stackably and engageably tiered each container is correspondingly offset with respect to the container above and below it an amount sufficient to permit access to the articles within the compartment of each said container.

6. The container display of claim 5 further including a base having a top surface for supporting thereon a plurality of stackably tiered containers, said top surface being inclined at an angle such that the center of gravity of said stackably tiered containers is generally above said base.

7. The container display of claim 6 wherein the top surface of said base includes a shallow depression for accepting thereinto the bottom surface of said container thereby aiding in a securement of a container engaged with said base, and a female element disposed in said shallow depression and engageable with a male element of a container to thereby unify said base to the first container engaged therewith.

8. The container of claim 4 wherein one sidewall includes a cutout smaller than the size of the articles contained therein for allowing fingre access to said articles contained within said compartment.

9. The container of claim 4 wherein said container includes a top surface above the bottom of said compartment having therein a downwardly depending well comprising said female element.

10. A container with an article compartment having four inner sidewalls and a bottom, and nestable with other similar empty containers to form a vertically registered stacked arrangement, and engageable with other similar containers containing articles to form a vertically staggered tiered display, comprising:

an outer circumferential sidewall forming a skirt surrounding said container and closely spaced with respect to three of the inner sidewalls of said compartment, said three inner sidewalls are connected at the tops thereof to said skirt to form a double wall construction;

a first and second substantially identical engaging means nestable with like means of other similar empty containers when nested, and engageable with respective second and first engaging means of other similar containers when engaged to form said staggered display, (a) said first engaging means comprises a hollow protrusion with peripherally enclosed sidewalls formed in the bottom of said compartment and extending downwardly below said skirt, (b) said second engaging means comprises a well with peripherally enclosed sidewalls independent of and removed from the sidewalls of said compartment, said well being located between said skirt and the fourth inner sidewall of said compartment and thereby being displaced laterally with respect to said hollow protrusion and displaced vertically with respect to said hollow protrusion; and wherein each sidewall of said compartment is a continuous planar surface and each vertical surface of said container includes a slight draft angle to facilitate nesting of a plurality of said containers.

* * * * *